US007947333B2

(12) United States Patent
Eriksson et al.

(10) Patent No.: US 7,947,333 B2
(45) Date of Patent: May 24, 2011

(54) METHOD FOR COATING OF METALLIC COIL OR SHEETS FOR PRODUCING HOLLOW ARTICLES

(75) Inventors: Mats Eriksson, Ytterby (SE); Thomas Wendel, Schwalbach (DE); Hardy Wietzoreck, Frankfurt am Main (DE)

(73) Assignee: Chemetall GmbH, Frankfurt am Main (DE)

( * ) Notice: Subject to any disclaimer, the term of this patent is extended or adjusted under 35 U.S.C. 154(b) by 1174 days.

(21) Appl. No.: 11/396,268

(22) Filed: Mar. 31, 2006

(65) Prior Publication Data

US 2007/0231496 A1 Oct. 4, 2007

(51) Int. Cl.
*B05D 7/14* (2006.01)
*B05D 3/12* (2006.01)

(52) U.S. Cl. ..... 427/419.1; 427/355

(58) Field of Classification Search ..... 427/405, 427/409, 419.1, 355–358, 367; 220/906, 220/917, 62
See application file for complete search history.

(56) References Cited

U.S. PATENT DOCUMENTS 4,978,588 A * 12/1990 Adaniya et al. ..... 428/650
5,139,586 A * 8/1992 Das ..... 148/246
5,603,754 A 2/1997 Aoki et al.

FOREIGN PATENT DOCUMENTS

WO WO 98/05804 2/1998

OTHER PUBLICATIONS

International Preliminary Exmaination Report for PCT/EP2007/052812, Sep. 30, 2008, 5 pages.*

* cited by examiner

*Primary Examiner* — William Phillip Fletcher, III
(74) *Attorney, Agent, or Firm* — Fulbright & Jaworski L.L.P.

(57) ABSTRACT

A method for coating of a metallic coil or of metallic sheets with an aqueous coating composition comprising at least one compound selected from the group consisting of zirconium compounds, titanium compounds and hafnium compounds whereby the such treated metallic coil or metallic sheets is/are shaped by cold extruding, by deep-drawing, by drawing, by necking, by punching, by wall ironing or by any combination of such process steps to a hollow article like a container or a casing and is then cleaned and optionally further coated either by chemical pre-treatment and then by coating with ink or paint or both or by chemical treatment.

24 Claims, 2 Drawing Sheets

Fig. 1: Process flow charts of a line with a fluoride containing cleaning step in stage 2:

Process A:

| Stage 0: Pre-rinse, not heated | Stage 1: Pre-cleaning 50-60°C | Stage 2: Cleaning 50-75°C | Stage 3 A/B: Rinse in two stages, not heated | Stage 4: Dome stain (pre-) treatment 35-60°C | Stage 5 A/B: Rinse in two stages, not heated | Stage 6: Rec. DI water, not heated | Stage 7: Mobility enhancer, not heated |
|---|---|---|---|---|---|---|---|

Process B:

| Stage 0: Pre-rinse, not heated | Stage 1: Pre-cleaning 50-60°C | Stage 2: Cleaning 50-75°C | Stage 3 A/B: Rinse in two stages, not heated | Stage 4: Water-rinse, not heated | Stage 5 A/B: Rinse in two stages, not heated | Stage 6: Rec. DI water, not heated | Stage 7: Mobility enhancer, not heated |
|---|---|---|---|---|---|---|---|

Process C:

| Stage 0: Pre-rinse, not heated | Stage 1: Pre-cleaning 50-60°C | Stage 2: Cleaning 50-75°C | Stage 3 A/B: Rinse in two stages, not heated | Stage 4: Water-rinse, not heated | Stage 5 A/B: Rinse in two stages, not heated | Stage 6: Rec. DI water, not heated | Stage 7: Rec. DI water, not heated |
|---|---|---|---|---|---|---|---|

(Prior Art)

Fig. 2: Process flow charts of a line with a fluoride-free containing cleaning step:

Process D:

| Stage 0: Pre-rinse, not heated | Stage 1: Pre-cleaning 50-75°C | Stage 2: Cleaning 50-75°C | Stage 3 A/B: Rinse in two stages, not heated | Stage 4: Dome stain (pre-) treatment 35-60°C | Stage 5 A/B: Rinse in two stages, not heated | Stage 6: Rec. DI water, not heated | Stage 7: Mobility enhancer, not heated |
|---|---|---|---|---|---|---|---|

Process E:

| Stage 0: Pre-rinse, not heated | Stage 1: Pre-cleaning 50-75°C | Stage 2: Cleaning 50-75°C | Stage 3 A/B: Rinse in two stages, not heated | Stage 4: Water-rinse, not heated | Stage 5 A/B: Rinse in two stages, not heated | Stage 6: Rec. DI water, not heated | Stage 7: Mobility enhancer, not heated |
|---|---|---|---|---|---|---|---|

Process F:

| Stage 0: Pre-rinse, not heated | Stage 1: Pre-cleaning 50-75°C | Stage 2: Cleaning 50-75°C | Stage 3 A/B: Rinse in two stages, not heated | Stage 4: Water-rinse, not heated | Stage 5 A/B: Rinse in two stages, not heated | Stage 6: Rec. DI water, not heated | Stage 7: Rec. DI water, not heated |
|---|---|---|---|---|---|---|---|

METHOD FOR COATING OF METALLIC COIL OR SHEETS FOR PRODUCING HOLLOW ARTICLES

BACKGROUND OF THE INVENTION

The invention concerns a method for coating of a metallic coil or of metallic sheets with a composition for treatment or pre-treatment whereby the such treated metallic material is further on shaped to an article like a container or a casing, especially to a can, and then cleaned and optionally further either chemically pretreated and then coated with ink or paint or chemically treated. In the following, the production line of a two-pieces aluminum can is selected to demonstrate on the one side the conventional process of today and on the other side a process according to the invention.

In today can production, an aluminum can plant buys aluminum coils at an aluminum coil mill having an aluminum cold rolling facility. The aluminum coil stock is typically of a specific alloy type which is used in many can plants. These aluminum coils are then sent to the can plant having a so called post-lube applied on the surface. The post-lube is an oil or an ester based composition, typically having a considerable amount of vegetable oil or mineral oil or both. The post-lube aids in the corrosion protection of the metallic material.

The aluminum alloy coil used for the can production is often rolled down to a wall thickness in the range from 0.45 to 0.25 mm at the aluminum mill, whereas a wall thickness e.g. of 0.25 mm is reduced during the shaping process at the can plant to a wall thickness e.g. of 0.10 mm, often in about 4 or 5 process steps in a body-maker.

First, at the front end of the can plant, the coil, which carries typically an oil containing post-lube upon its surfaces, is hold in an uncoiler for unwrapping the coil.

Then, a lubricant composition is applied which may contain oil, ester(s), emulsifier(s) or water or any combination thereof upon the coil e.g. with the aid of a spray nozzle. It may be called "post-lube" too and may be of the same or of a similar composition compared with the first post-lube. This lubricant composition is applied to the coil, which is then used for aiding in the shaping of the can, typically just before or in the "cup-maker" or both. After the cup-maker has produced pre-formed cans called "cups", the cups are transported to a so called body-maker machine ("body-maker").

The body-maker typically uses a composition which contains oil, emulsifier(s), ester(s), coolant(s) or any combination thereof for the further shaping and the cooling of the tools and the shaped component. This equipment shapes the cups by a drawing and wall ironing process to the final shape and to the final surface quality of the surfaces as it is well-known e.g. as a beer can or as a cola can. The drawing and the wall ironing process or similar shaping processes cause so much force onto the aluminum material that the aluminum alloy in the tools flows like in a cold-forming operation. After the shape of the so-called "body" is generated, the top of the drawn cup is cut ("trimmed" in a "trimmer"), and the cans are transported to the so-called "washer" having several baths where in today processes, in different process steps cleaning is performed and where typically different chemicals are applied in different baths. In between and optionally at the end of the washer too, there is at least one water rinsing.

Aluminum cans are today produced at a speed of 1000 to 4000 can units per minute in one line, which are often drawn and wall ironed by up to 10 parallel body-makers, but often only drawn to cups by only 1 cup-maker before in this line.

The typical (pre-) treatment process in a can washer may often comprise the following stages:

1. Pre-rinsing—stage 0
2. Pre-cleaning—stage 1
3. Acidic cleaning—stage 2
4. Rinsing A/B—stage 3a
5. Dome stain (pre-) treatment—stage 4
6. Rinsing A/B—stage 5
7. DI rinsing—stage 6 (deionized, often even recycled, water)
8. Mobility Enhancer—stage 7.

The can bodies coming from the body-maker typically have very smooth outer surfaces, but need to be cleaned. Gardobond® S 5240 und Gardobond® 45 CR of Chemetall GmbH may be used in the (pre-) cleaning stages to get rid of oil, dirt and other contaminants like the burnt oil and other burnt organic components which may cause the can body to look black and to remove thereby the content of post-lube, of cupping lube and of body-maker coolant/lube. Such aqueous acidic cleaning compositions may contain free fluoride or $Fe^{2+}$ together with at least one oxidizing agent like a peroxide. But the longer or the stronger the etching in the acidic bath is, the rougher the can body may become. The color of the can body may even turn to white, if there is a too strong etching. And the can body has to be rejected too, if it has a very high friction. The can bodies cannot be transported in an adequate way without application of a mobility enhancer if they show a certain roughness. By lowering the etching rate, there is less or no need for applying a mobility enhancer.

The can may then be (pre-) treated with an aqueous composition for a conversion coating typically based on Zr, F and $PO_4$, e.g. with the product Gardobond® 1450 N or Gardobond® 764 of Chemetall GmbH or with Alsurf 450® of Nippon Paint Corp. in the so-called "stage 4 process" or "dome stain treatment" of the washer so that the bottom (dome) of the can is protected during the pasteurization against corrosion as the pasteurization is often necessary especially for beer cans. This dome stain treatment typically leads to a zirconium containing coating having a zirconium content to be measured as elemental zirconium in the range from 2 to 14 $mg/m^2$ Zr. The application of such compositions in a can washer is a difficult process due to the limited stability of the system and due to the sludge generation. The generated coating often affects the mobility of the cans. The mobility of the cans which stand and roll one parallel to the other standing on a transportation belt or on a transportation mat is significantly influenced by the gliding properties of the can surfaces and of the coatings on the can bodies. The mobility is directly related to production speed in the can plant. The higher the mobility is, the higher may be the production speed and the production capacity.

By applying a so-called "mobility enhancer" to the can body especially in stage 7 of the washer, e.g. an aqueous composition on the base of a mixture of surfactants in aqueous solution, the gliding ability of the mostly rough surface of the can body is improved.

The cans may be shipped to a brewery, where e.g. beer may be pasteurized either prior to filling it into the cans or after having filled it into the cans. In the last case, especially the not further treated outer surface of the dome may underlie corrosion e.g. by blackening if there is an insufficient corrosion protection. The pasteurizing is often conducted with hot water of about 75 to 95° C. At this temperature, the dome would become white to grayish and sometimes even black because of the start of corrosion at the metallic surface if it is not corrosion protected. Therefore, a protection of the dome outside surface is important as only the other outer surfaces as well as to the inner surfaces independent one from the other are painted or printed with ink or paint or both. Such a color change has to be avoided.

We have found that the content of phosphoric acid of a typical cola may corrode the wall of a typical aluminum can in about 6 hours if there is no inside corrosion protection. Therefore, even breakings and cracks of the metallic material and of its coatings should be reduced or even avoided to minimize the risk of corroding such cans not only on the inner surface, but even to avoid crevice corrosion.

This conventional process in a can washer often shows the following disadvantages:

The succession of baths and (pre-) treatments of the can bodies in the washer is complex and difficult, and it is a sensitive system, even in relation to the shaping operations before. The most disadvantageous effects are related to the dome stain (pre-) treatment and to the mobility enhancer (pre-) treatment.

1) The dome stain (pre-) treatment is often disadvantageous because of:

a) The effect of reducing the glidability of the can bodies because of the perhaps more or less crystalline and typically relatively rough coating generated with the dome stain composition.

b) The loss of paint adhesion in the necking area of the can bodies, which is nearby to the area where the lid will be joined to, as the more or less crystalline dome stain coating is not flexible enough to be significantly bent in the necking area and causes micro-cracks and fractures during bending which causes micro-cracks and fractures of the paint layer applied upon the dome stain coating too whereby the micro-cracks and fractures occur primarily in the segments of convexly bent outer regions, especially if they are coated with a highly pigmented ink or highly pigmented paint or both, whereby white bare rust may later occur; therefore, it would be a great advantage to avoid this failure type.

c) The temperature of the dome stain (pre-) treatment bath is often in the range from 35 to 60° C. which is expensive.

d) The costs of the chemicals in the dome stain (pre-) treatment.

e) Sludge generation, which causes pauses for cleaning the baths during which there is no production in the line.

f) The disposal of waste water, chemicals and sludge.

g) In the bath for a dome stain (pre-) treatment only a very low sulfur content is acceptable, but easily a certain sulfur content of the acidic cleaning bath may be introduced: If a body is standing upwards and not downwards, which occurs in some situations, such upstanding can body in stage 4 introduces sulfuric acid and other acids from the acidic cleaning solution into the bath of stage 4, which should therefore have a continuous overflow and a loss of chemicals to ensure a very low sulfur content in the bath.

h) The (pre-) treatment time to be used is only very few seconds for one can body, but if the can transportation speed is reduced or if there occurs a line stop, the dome stain coating has more time to develop and is therefore thicker and rougher. Then the glidability of this coating is significantly reduced.

Therefore, it would be a significant advantage to avoid a dome stain (pre-) treatment or to use a dome stain (pre-) treatment which does not generate a rough crystalline coating like coatings on the base of at least one phosphonate as it is possible to use so-called "self-assembling molecules" (SAM) on the base of at least one compound selected from the group of phosphonic acids, phosphonates and their derivatives and/or to use a dome stain (pre-) treatment with less environmentally unfriendly consequences.

A mobility enhancer shall create a well glidable coating on the surface of the can body, so that a more or less rough surface is flattened and made better glidable than without such coating.

2) The use of a mobility enhancer is often disadvantageous because of:

a) The mobility enhancer composition—in the following called "mobility enhancer"—is today often an aqueous composition on the base of surfactants or esters or both. The higher the concentration of the mobility enhancer is or the longer it is applied e.g. during a line stop, problems may occur in painting or printing the can afterwards: The more hydrophilic the surface coated with the mobility enhancer is, the easier may occur wetting problems, if an ink or a paint is used which is more hydrophobic as the typically used paints or inks or both for the outer surfaces of a can or an article are more hydrophobic. There may then a problem occur because of insufficient adherence to the surface. But typically, there does not occur a problem on the inner surfaces of a can or of an article, as there is often used a hydrophilic ink or paint or both.

b) There may occur a dirt from a mobility enhancer which may cause a type of failure called "salt rings" which may be caused by a too high concentration of a mobility enhancer bath, especially occurring when a high mobility enhancer concentration is applied to the standing can body, when the mobility enhancer forms a liquid film ring at the bottom and dries on. Such salt rings are a reason for rejection of the such coated shaped bodies.

The percentage of rejections because of the dome stain (pre-) treatment and of the mobility enhancer (pre-) treatment may be at least 0.1% of the whole can production, perhaps even sometimes more than 1%, which is a high cost factor in such a mass production. These two production stages seem to be typically the stages with the highest failure rates. One can production line only may have costs because of the rejection of cans in the range of vaguely half a million € per year.

It is therefore an object of the invention to propose an easier or cheaper method for producing hollow articles like cans and casings. It is another object of the invention to propose a method for producing hollow articles like cans and casings in a less complex, less instable or shorter process succession.

We have now found that there may often occur micro-cracks in the aluminum alloy of cans at the dome outside surface, which seem to arise from the shaping in the body-maker. Such cracks may hold oil inside, as the capillary forces are very strong, even despite heating and high spray pressures. The oil may remain in the micro-cracks, so that the oil may spread out of the micro-cracks if the can is heated as the inside of the can is not yet painted. The later-on (subsequently) applied water-based paint is then not able to cover the small oil covered areas of the inside surface. Then there is no paint in such areas, and at these flaws, there is no corrosion protection. Therefore, it is preferred to optimize the shaping process even so to reduce the numbers and the size of the micro-cracks during the shaping steps.

We have now found that there are several advantages if the shaped can body is not coated with the specific chemicals of the "stage 4 process" conventionally used today on the base of Zr, F and $PO_4$ in stage 4 of the washer, but if the metallic coil or the metallic sheets are already coated before.

We have now found that at least a part of the content of zirconium applied in a zirconium rich coating on coil may remain on the surface or in the surface layer or both of the metallic material during the shaping and even during the cleaning after the shaping, which is very surprising.

We have now found that a can may be produced with a perfect dome stain resistance without using the conventional "stage 7 process" with a mobility enhancer, if a metallic coil or if metallic sheets are precoated with an adequate corrosion resistant coating. This stage may be therefore omitted or may be replaced e.g. by a rinsing stage with water or with water having a low surfactant(s)' content. Such an omission is only possible if the metallic material stock had shown an adequate coating before the shaping which remains during the process at least partially on the metallic surface or leads to a modified metallic surface or both.

An investigation revealed that zirconium is present at the surface of a can body, although no dome stain (pre-) treatment or no other zirconium containing composition had been applied in the washer.

It was surprising that the zirconium content of the zirconium containing passivation layer present on the metallic coil or on the metallic sheets tested was not totally removed in the shaping and in the thereon following cleaning process. Therefore, it is believed that the zirconium content of this coating was transformed into the surface of the aluminum alloy during the shaping especially during the drawing and wall ironing steps in the body-makers, especially due to the high pressure and perhaps due to the high temperatures present during shaping.

We have found that the coating applied on the metallic surface is able to aid in the shaping process of the metallic coil or metallic sheets as well as in the further shaping of the pre-shaped bodies like cups and (can) bodies, especially in the cup-maker or in the body-maker or both of a can manufacturer.

SUMMARY OF THE INVENTION

The invention concerns a method for coating of a metallic coil or of metallic sheets with an aqueous coating composition comprising at least one compound selected from the group consisting of zirconium compounds, titanium compounds and hafnium compounds whereby the such treated metallic coil or metallic sheets is/are shaped by cold extruding, by deep-drawing, by drawing, by necking, by punching, by wall ironing or by any combination of such process steps to a hollow article like a container or a casing and is then cleaned and optionally further coated either by chemical pretreatment and then by coating with ink or paint or both or by chemical treatment.

DESCRIPTION OF THE PREFERRED EMBODIMENT(S)

If a chemical "treatment" is used, no paint and no ink are applied further on. If a chemical "pre-treatment" is used, a paint or an ink or both are applied after the (pre-treatment. The chemical (pre-) treatment may be in some embodiments only a cleaning or starts with a cleaning, whereby the cleaning may be an alkaline cleaning or an acidic cleaning or both one after the other.

The definition of the shaping processes like cold extruding, deep-drawing, drawing, necking, punching and wall ironing are to be seen to be defined in a broad manner. They as well as the term "shaping" itself shall cover all cold forming processes which may be used for the shaping of metallic coil or metallic sheets to hollow articles which cause a significant flow of material inside the metallic material.

In the following, the process according to the invention is and its effects are demonstrated for an aluminum can line, but similarly, other containers or even casings or other hollow articles may be produced in an identical or in a similar process.

In the method according to the invention, the article to be produced may preferably be a can. More preferred, the can is produced as a two-piece can having a can body and a lid joined later on e.g. by adhesive bonding to complete the can. In contrast thereto, the cans for food are more often produced as three-piece cans: They are composed of a bottom, a body and a lid, and there is in many cases no drawing necessary for the shaping of the metallic components.

Preferably, the article is produced from a metallic coil or from metallic sheets made of aluminum, aluminum alloy or tinplate. Nevertheless, if the materials of the metallic coil or of the metallic sheets to be shaped would show adequate material's properties, other metallic materials e.g. like magnesium alloy, steel, zinc, zinc-coated or alloy-coated metallic material may be used, too. Especially preferred are materials selected from the group consisting of the aluminum alloys 3104, 5052, 5154A and 5182 as well as of tinplates. Here, often an aluminum alloy like Al 3104 is used for the production of the bodies e.g. for a two-piece can, which is here only used as an example for the use of the invention.

The coating according to the invention may preferably be applied in a coil coating line on a metallic coil or elsewhere on metallic sheets. The metallic coil or the metallic sheets may preferably be coated by dipping, dipping and rinsing, dipping and squeezing, spraying, spraying and rinsing, spraying and squeezing, rollcoating, electrostatically spraying or by any combination of such process steps.

Preferably, the metallic coil or the metallic sheets are coated in a no-rinse process, especially with a liquid film of an aqueous coating composition in the range from 1 to 25 ml/m$^2$ especially for coil, more preferred from 2 to 15 ml/m$^2$ or 3 to 10 ml/m$^2$. If metallic sheets are coated, the liquid film applied may be even in the range from 1 to 100 ml/m$^2$, more preferred from 2 to 75 ml/m$^2$ or 3 to 50 or 4 to 30 ml/m$^2$. The coating may perhaps be seldom applied in a rinse process, but more often in a no-rinse process, where there is no rinsing afterwards with water, but where the liquid film is dried-on-place on the metallic surface. The drying is in both variations preferably performed at temperatures in the range from 18 to about 100° C. PMT (peak metal temperature).

Preferably, the metallic coil or the coated metallic sheets is/are dried, whereby a treatment coating with a coating weight is produced in the range from 4 to 300 mg/m$^2$, more preferred in the range from 6 to 150 mg/m$^2$, most preferred in the range from 8 to 80 or from 10 to 50 mg/m$^2$.

Preferably, the coated metallic coil or the coated metallic sheets show(s) a coating with a content of hafnium, titanium or zirconium or any combination of them in the range from 1 to 50 mg/m$^2$, measured as the element, more preferred in the range from 2 to 30 mg/m$^2$, most preferred in the range from 3 to 20 or from 4 to 15 mg/m$^2$, for the sum of these elements as far as present. Especially preferred is a content of zirconium in the range from 1 to 40 mg/m$^2$, measured as the element, more preferred in the range from 2 to 30 mg/m$^2$, most preferred in the range from 3 to 20 or from 4 to 15 mg/m$^2$. The same ranges apply for a content of titanium or a content of hafnium.

Preferably, the coated metallic coil or the coated metallic sheets show(s) a coating having an essential content of at least one type of fluorine containing anion like fluoride, of at least one hydroxide, of at least one oxide, of at least one phosphate or of any combination thereof whereby the coating has a content of hafnium, titanium, zirconium or any combination thereof.

Preferably, the aqueous coating composition contains water, at least one compound selected from zirconium compounds, titanium compounds and hafnium compounds as well as optionally at least one compound selected from the group consisting of the following classes and compounds: Phosphates, condensed phosphates, phosphonic acids, phosphonates and their derivatives; hydrofluoric acid, monofluorides, bifluorides, complex fluorides; tannins, tannic acid, tannin complexes; phenolic compounds and their derivatives, especially such with properties similar to tannins, tannic acid or tannin complexes; compounds contained in organic polymeric dispersions or even at least one dispersion may be added; organic polymers, copolymers, blockcopolymers and grafted copolymers, especially such on the base of acryl, epoxy, polyester, styrol, urethane or any combination thereof; waxes; boron containing compounds like boric acid, boric complex fluoride and ammonium borate; alkali metal compounds; ammonium compounds; inorganic nanoparticles like such on the base of rare earth compounds, zinc, zinc compounds, oxides, silica or silicates; nitrates; sulfates; silanes, siloxanes, polysiloxanes and their derivatives; aluminum compounds; compounds of rare earth elements like cerium compounds; yttrium compounds; manganese compounds; molybdenum compounds; tin compounds; amines and their derivatives like alkanolamine; complexing agents; carboxylic acids like ascorbic acid, citric acid, lactic acid and tartaric acid as well as their derivatives; surfactants; additives like antifoaming agents and biocides as well as organic solvents. The organic solvent(s) are typically only added if there is a content of at least one organic polymeric material.

An addition or content of at least one compound selected from the group of tannins, tannic acid, tannin complexes, phenolic compounds and their derivatives may aid in corrosion protection, especially in dome stain resistance. An addition or content of at least one compound selected from the group of silanes, siloxanes, polysiloxanes and their derivatives may aid during the shaping process. An addition or content of at least one boron containing compound may perhaps be used for the complexation or for the stabilization of constituents or both of the aqueous coating composition.

Preferably, the aqueous coating composition for coating the metallic coil or the metallic sheets contains in many embodiments according to the invention besides of water at least one compound of each group of 1) zirconium, titanium and hafnium compounds, 2) hydrofluoric acid, monofluorides, bifluorides and complex fluorides, 3) phosphates, condensed phosphates, phosphonic acids, phosphonates and their derivatives as well as 4) optionally at least one compound each of nitrogen compounds, of organic polymers, copolymers, blockcopolymers and grafted copolymers or of tannins, tannic acid, tannin complexes, phenolic compounds and their derivatives or any combination thereof. In some embodiments of the present invention, it may contain besides of water at least one compound of each group of 1) zirconium, titanium and hafnium compounds as well as 2) hydrofluoric acid, monofluorides, bifluorides and complex fluorides. In some embodiments, this composition may essentially consist of the compounds as mentioned here above under the groups 1) to 4) or under the groups 1) to 2). Further on, in such embodiments, there may be a small amount of compounds like at least one nitrogen compound like a nitrate or an amine or both, like a sulfate, like a complexing agent or like an additive, whereby the sum of such compounds is often preferably not more than 0.5 g/L.

The content of the sum of zirconium compounds, titanium compounds and hafnium compounds in the coating composition is preferably in the range from 0.05 to 50 g/L, more preferred in the range from 0.2 to 30 g/L, most preferred in the range from 0.5 to 15 g/L. The content of the sum of zirconium, titanium and hafnium calculated or measured as the elements in the coating composition is preferably in the range from 0.01 to 15 g/L, more preferred in the range from 0.1 to 12 g/L, most preferred in the range from 0.3 to 8 g/L. Within the group of zirconium compounds, titanium compounds and hafnium compounds, the at least one zirconium compound seem to be the most important one. The content of the sum of phosphates, condensed phosphates, phosphonic acids, phosphonates and their derivatives in the coating composition calculated by excluding the proportion of the cations is preferably in the range from 0.05 to 25 g/L, more preferred in the range from 0.2 to 12 g/L, most preferred in the range from 0.5 to 8 g/L. The content of the sum of hydrofluoric acid, monofluorides, bifluorides and complex fluorides in the coating composition is preferably in the range from 0.01 to 50 g/L, more preferred in the range from 0.1 to 30 g/L, most preferred in the range from 0.3 to 8 g/L.

The content of the sum of tannins, tannic acid, tannin complexes, phenolic compounds and their derivatives in the coating composition is preferably in the range from 0.01 to 15 g/L, more preferred in the range from 0.1 to 12 g/L, most preferred in the range from 0.3 to 8 g/L. The content of the sum of organic polymers, copolymers, blockcopolymers and grafted copolymers in the coating composition is preferably in the range from 0.01 to 15 g/L, more preferred in the range from 0.1 to 12 g/L, most preferred in the range from 0.3 to 8 or from 1 to 5 g/L. The content of the sum of compounds contained in organic polymeric dispersions or even the dispersions are added as well as the content of waxes in the coating composition is preferably in the range from 0.01 to 10 g/L, more preferred in the range from 0.05 to 7 g/L, most preferred in the range from 0.1 to 4 g/L. The content of the sum of boron containing compounds in the coating composition is preferably in the range from 0.01 to 15 g/L, more preferred in the range from 0.1 to 12 g/L, most preferred in the range from 0.3 to 8 g/L. The content of the sum of inorganic nanoparticles in the coating composition is preferably in the range from 0.01 to 3 g/L, more preferred in the range from 0.03 to 1 g/L, most preferred in the range from 0.05 to 0.5 g/L. The content of the sum of complexing agents, nitrates, sulfates, amines, carboxylic acids, their derivatives as well as additives in the coating composition is preferably in the range from 0.01 to 10 g/L, more preferred in the range from 0.05 to 6 g/L, most preferred in the range from 0.1 to 3 g/L. The content of the sum of silanes, siloxanes, polysiloxanes and their derivatives in the coating composition is preferably in the range from 0.01 to 10 g/L, more preferred in the range from 0.03 to 4 g/L, most preferred in the range from 0.05 to 1 g/L. The content of the sum of aluminum ions, ions of rare earth elements, yttrium ions, manganese ions, molybdenum ions and tin ions in the coating composition is preferably in the range from 0.01 to 6 g/L, more preferred in the range from 0.03 to 3 g/L, most preferred in the range from 0.05 to 1 g/L. Preferably, at least one organic solvent is only used if there is a content of at least one organic polymeric material, more preferred only a low content like up to 5 g/L.

If a no-rinse process is used, it may be preferred to have a low cation content especially of alkali metal cations which may preferably be at least partially replaced by ammonium ions. Preferably, the content of alkali metal ions is in the range from 0.01 to 3 g/L, more preferred in the range from 0.03 to 1 g/L, most preferred in the range from 0.05 to 0.5 g/L. The content of ammonium ions in the coating composition is preferably in the range from 0.01 to 6 g/L, more preferred in the range from 0.1 to 4 g/L, most preferred in the range from 0.2 to 2 g/L.

The coating generated on the metallic coil or on the metallic sheets may preferably contain 1 to 50 mg/m$^2$ of zirconium measured as the element, more preferred 2 to 35 mg/m$^2$, most preferred 3 to 25 mg/m$^2$.

Preferably, the surface of the metallic coil or of the metallic sheets according to the invention is coated with a coating on the base of at least one compound selected from the group of zirconium compounds, titanium compounds and hafnium compounds which aids as a passivation layer whereby this coating may show a content of at least one compound selected from the group consisting of at least one type of fluorine containing anion like fluorides, hydroxides, oxides, phosphates and other compounds.

In a cup forming step, which may be the first shaping step, the wall thickness of the metallic coil/sheet may be reduced e.g. by about 2 to 12% of the cup wall thickness, but in a body-maker—which may be used e.g. in a drawing and wall ironing step which may be mentioned as "drawn and ironed" ("D and I operation"), the cups may have to pass, e.g., 4 sets of rings pushed by an internal punch that forces the metallic material to start flowing.

In a shaping machine such as a cup-maker, e.g., 24 or 36 singular cups may be shaped from the coated metallic coil or from the coated metallic sheets e.g., by punching in one punching step, which cups may be then about 0.5 to 5 cm high, for beverage cans often about 3 cm high.

The cups may then be shaped further e.g. in a body-maker e.g. by punching with a punching press the cups into, e.g., 4 rings one after the other whereby the diameter of each cup is significantly narrowed and whereby optionally a dome or a necking or any other specific geometry or any combination thereof may be generated. Thereby, the wall thickness of the shaped bodies may be significantly reduced, e.g. from about 0.2, 0.25 or 0.3 mm down to e.g. 0.08, 0.1, 0.12 or 0.15 mm. The temperature of the tool of the shaping may be e.g., in the range from 60 to 110° C., especially in the range from 80 to 90° C. The high forces during the shaping may lead to high temperatures of the formed cup, which may then be immediately cooled down in contact with a composition containing an oil, emulsifier(s), ester(s), coolant(s), water or any combination thereof. This composition may especially be a hydrolic oil-based emulsion, whereby the content of an oil compared by including all typical additives of such a composition may in some cases be smaller than the content of the at least one coolant in this post-lube or coolant composition or both. In a shaping machine like a body-maker, this composition may be pressed onto the parts to be shaped with a certain pressure like about 4 bars to cool the parts and the tools.

Preferably, the coated metallic coil or the coated metallic sheets is/are shaped, whereby an oil containing film is maintained on the coated or modified metallic surface of the coil or sheets or both during the shaping, whereby the oil containing film is hold on the metallic surface better than without any content of hafnium, titanium, zirconium or any combination thereof in the surface layer or in the coating. The composition of the oil containing film may vary significantly depending on the main constituents added at a further process station like a body-maker and may predominantly contain oil, ester(s) or coolant(s).

Herein, the terms "bodies", "shaped bodies" and "shaped articles" shall mean the same.

There may occur a significant reduction of wear of the tools coated which show a content of hafnium, titanium, zirconium or any combination thereof or having a coating with such a content or both.

The coating may aid in the lubrication during at least one shaping step, e.g. in forming a cup or a body or both of a shaped article, by increasing the lubricity by using an oil, emulsifier(s), ester(s), coolant(s) or any mixture thereof containing composition as film on the cups, bodies, shaped articles or any combination of these in at least one shaping machine like in the body-maker.

Preferably, the coated metallic coil or the coated metallic sheets is/are shaped in a cup-maker and in a body-maker.

The higher the oil content of this composition is, the better may be in some embodiments the punching effect, but the better must be the cleaning afterwards in the washer. Therefore, a high oil content may be preferred.

Preferably, the coating showing a content of hafnium, titanium, zirconium or any combination thereof is not totally removed in the shaping and in the cleaning process, but is at least partially maintained after the shaping like in a cup-maker and in a body-maker or cleaning or both and optionally during the further process succession in the washer, either as a layer, as residues of the coating or as a modified metallic surface which has at least a minor content of the coating incorporated into the metallic material or as any combination of these. The coating applied to the metallic coil or to the metallic sheets may give the hollow article produced a layer or a modified metallic surface or both that may aid to resist or resists to corrosion in a process like the pasteurization e.g. of food, beverage, etc., especially in the region of a dome.

In many embodiments, at least a part of the zirconium, titanium, hafnium or any combination thereof as present in the corresponding compounds is incorporated into the surface of the metallic material during the shaping, whereby a modified surface is generated.

Preferably, the coated metallic coil or the coated metallic sheets is/are shaped in such way, that the hafnium, titanium, zirconium or any combination thereof from the corresponding compounds present is at least partially taken from the coating into the metallic material, whereby at least a part of the metallic surface is modified.

Hereby, a surface layer which may show a continuous transition to the inner or to the other parts of the metallic material may in some cases be generated which is modified in comparison to the original metallic material. It may also occur that the modified material is even located in thin zones in the inner parts of the metallic material by the way of shaping.

Preferably, the coated metallic coil or the coated metallic sheets is/are shaped in a way such that the coating containing at least one compound selected from the group of zirconium compounds, titanium compounds, hafnium compounds or any combination thereof or its constituents is/are at least partially incorporated into the metallic material during the shaping, especially into a surface near region of the metallic material. Nevertheless, it may also occur that at least a minor part of the coating like residues is maintained as a layer on the shaped metallic coil or shaped metallic sheets.

It is believed that a content of zirconium, titanium, hafnium or any combination thereof at the surface or in the surface near region of the metallic material or both improves the flow of the metallic material during the shaping, whereby smaller or less cracks and a better corrosion resistance may be created.

Improved carrying and holding of an oil/emulsifier/ester/coolant-based composition on the metallic surface during the shaping under severe conditions is achieved by providing an amount of hafnium, titanium, zirconium or any mixture of these containing layer on the shaped metallic surface, by a chemically modified metallic surface or by both. A thinner film of such lubricant/coolant composition. Even the tools seem to work longer, which is a big advantage for the can maker, too, as there occur high costs at the cup-makers and the body-makers. The tool life may be prolonged from e.g. about 18 months to about 20 to 24 months e.g. for a specific cupping tool.

At least one acidic cleaning step for cleaning the bodies or shaped articles from dirt, oil, coolant(s) etc. is necessary, whereby the surface of the shaped articles is cleaned and optionally etched to get rid e.g. of the oxide generated upon the metallic surface especially on aluminum rich metallic materials. The aqueous acidic cleaning composition used for an etching may comprise at least one acid selected from the group consisting of hydrofluoric acid, sulfuric acid, nitric acid and other mineral acid(s) or may comprise at least one oxidizing agent like a peroxide like hydrogen peroxide e.g. together with ions of $Fe^{2+}$.

Preferably, the shaped metallic cups, bodies or articles are rinsed or cleaned or both. They may be cleaned in an alkaline solution or dispersion, cleaned or etched or both in an acidic solution or dispersion or cleaned in a combination of the same, of similar or of different cleaning steps in the baths' succession which may contain the same, similar or quite different chemical compositions like even a combination of alkaline cleaning and acidic cleaning. Preferably, the cleaning may be a weak etching whereby 1 to 12 $mg/m^2$ are removed from the surface of the metallic material, more preferred 2 to 8 $mg/m^2$.

The etching may be used to make the surface of the shaped article bright and clean. A low etching may remove 3 to 10 $mg/m^2$ e.g. of aluminum or aluminum alloy; but a high etching rate often creates an increased surface roughness which typically leads to higher friction which then lowers the production speed. Therefore, it may be favorable to control the punching and drawing very well not to increase the surface roughness by necessary high etching rates.

Preferably, at least a part of a surface or of the surfaces of the shaped metallic cups, bodies or articles which have been rinsed or cleaned or both shows a content of hafnium, titanium or zirconium or any combination of them which has its origin from the coating of the metallic coil or of the metallic sheets.

Preferably, the shaped metallic cups, bodies or articles are treated then in some embodiments according to the invention with a solution or dispersion for improving the corrosion resistance, for the mobility enhancement, for paint adhesion or ink adhesion or for any combination of these improvements.

Preferably, the bodies or articles, especially casings or containers like cans, are produced in some embodiments according to the invention without applying a mobility enhancer composition on their surfaces or with applying such a composition which is a less environmental unfriendly composition, a less concentrated composition, a less expensive composition, a composition generating a less rough coating or any combination thereof.

Preferably, the shaped metallic bodies or articles are produced in some embodiments according to the invention by applying a dome stain (pre-) treatment or a mobility enhancer (pre-) treatment or both on their surfaces which contains at least one composition comprising a content of at least one phosphonate or of at least one phosphonic acid or both, especially such compounds having molecules with an alkyl chain in a part or in a middle part of such molecules, most preferred with an alkyl chain showing 4 to 40 carbon atoms, which may have the same molecule structure as mentioned below.

During the dome stain (pre-) treatment, the aqueous composition may be, e.g., sprayed from the top only onto the top of a dome or of a base face from the outside of an, e.g., downward standing body. The dome stain (pre-) treatment may be omitted or further used in the process according to the invention, e.g. further used by applying an aqueous composition containing at least one phosphonate or phosphonic acid or both, especially at least one phosphonate or at least one phosphonic acid having an alkyl chain in the middle of the molecule, preferably of an alkyl chain with 4 to 40 or with 6 to 32 carbon atoms, more preferred with 8 to 20 carbon atoms, most preferred with 10, 12, 14, 16 or 18 carbon atoms, especially having an unbranched alkyl chain, or by applying another, primarily or totally inorganic aqueous composition.

By using no dome stain (pre-) treatment or a dome stain (pre-) treatment without any fluorine content, it is possible to create a process for treatment respectively pre-treatment without any fluorine content e.g. in the whole baths of the washer or only with a fluorine content in one or two baths like in a dome stain (pre-) treatment bath, which is a considerable advantage as there is an increasing demand of avoiding every content of fluorine. If there is a fluorine containing cleaning step in stage 2, a certain fluorine content is typically taken to the bath of stage 1 and optionally to the bath of stage 0, also.

Because of the coating of the used metallic coil or metallic sheets, especially aluminum alloy stock, according to the present invention, it may no longer be a necessity to provide a corrosion resistant (pre-) treatment like a dome stain (pre-) treatment. If there is no dome stain coating used or no rough coating generated, typically a less rough surface is generated on the shaped articles which exhibit an excellent gliding behavior and less friction so that there is no need for the application of a mobility enhancer.

A mobility enhancer (pre-) treatment enables 1) a lower friction, and 2) a lower surface tension of the water: Thereby, a better drying results, but the droplets at the bottom may lead to a slight salt ring because of the relatively high concentration of this bath. If another composition type is used for a mobility enhancer (pre-) treatment like an aqueous composition containing at least one phosphonate respectively phosphonic acid, especially having a longer alkyl chain in the middle of the molecule, this could result in significantly lowered friction of the can bodies, and no salt rings would occur, but often there would not be a lowered surface tension of the water except by addition of a small amount of at least one surfactant.

If fluorine, especially as a monofluoride, as a bifluoride, as hydrofluoric acid or as any combination thereof is added to or contained in a cleaning bath, it is often only added to the bath of stage 2. There may, however, be a certain fluorine backflow transmitted to the baths before, especially to the baths of the stages 1 and optionally 0.

The composition for treating or for pre-treating the surfaces of the shaped metallic articles, which may have been rinsed or cleaned and rinsed after the shaping process in many embodiments, preferably contains at least one compound besides of water selected from the group consisting of the following classes and compounds: zirconium compounds, titanium compounds and hafnium compounds like their complex fluorides or their hydroxide carbonates; phosphates, condensed phosphates, phosphonic acids, phosphonates and their derivatives; hydrofluoric acid, monofluorides, bifluorides, complex fluorides, hydrofluoric acid; tannins, tannic acid, tannin complexes; phenolic compounds and their derivatives, especially such with properties similar to tannins, tannic acid or tannin complexes; compounds contained in organic polymeric dispersions or even the dispersions are added; organic polymers, copolymers, blockcopolymers and grafted copolymers, especially those based on such on the base of acryl, epoxy, polyester, styrol, urethane or any combination thereof; waxes; boron containing compounds like boric acid, boric complex fluoride and ammonium borate; alkali metal compounds; ammonium compounds; inorganic nanoparticles like such on the base of rare earth compounds, zinc, zinc compounds, oxides, silica or silicates; nitrates; sulfates; silanes, siloxanes, polysiloxanes and their derivatives; aluminum compounds; compounds of rare earth elements like cerium compounds; yttrium compounds; manganese compounds; molybdenum compounds; tin compounds; amines and their derivatives like alkanolamine; complexing agents; carboxylic acids like ascorbic acid, citric acid, lactic acid and tartaric acid as well as their derivatives; surfactants; additives like antifoaming agents and biocides as well as organic solvents. The organic solvent(s) are typically only added if there is a content of at least one organic polymeric material. A composition containing at least one compound selected from the group consisting of silanes, siloxanes, polysiloxanes and their derivatives may be used to replace a corrosion resistant (pre-) treatment like a dome stain (pre-) treatment or a mobility enhancer, or both.

Preferably, the aqueous composition for (pre-) treating the shaped articles contains water, at least one compound selected from zirconium compounds, titanium compounds and hafnium compounds as well as optionally at least one compound selected from the group consisting of the following classes and compounds: phosphates, condensed phosphates, phosphonic acids, phosphonates and their derivatives; hydrofluoric acid, monofluorides, bifluorides, complex fluorides; tannins, tannic acid, tannin complexes; phenolic compounds and their derivatives, especially such with properties similar to tannins, tannic acid or tannin complexes; compounds contained in organic polymeric dispersions or even the dispersions are added; organic polymers, copolymers, blockcopolymers and grafted copolymers, especially such on the base of acryl, epoxy, polyester, styrol, urethane or any combination thereof; waxes; boron containing compounds like boric acid, boric complex fluoride and ammonium borate; alkali metal compounds; ammonium compounds; inorganic nanoparticles like such on the base of rare earth compounds, zinc compounds, silica or silicates; nitrates; sulfates; silanes, siloxanes, polysiloxanes and their derivatives; aluminum compounds; compounds of rare earth elements like cerium compounds; yttrium compounds; manganese compounds; molybdenum compounds; tin compounds; amines and their derivatives like alkanolamine; complexing agents; carboxylic acids like ascorbic acid, citric acid, lactic acid and tartaric acid as well as their derivatives; surfactants; additives like antifoaming agents and biocides as well as organic solvents.

Preferably, at least one organic solvent is only used if there is a content of at least one organic polymeric material, more preferred only a low content like up to 5 g/L. An addition or content of at least one compound selected from the group of tannins, tannic acid, tannin complexes, phenolic compounds and their derivatives may aid in corrosion protection, especially in dome stain resistance. An addition or content of at least one compound selected from the group of silanes, siloxanes, polysiloxanes and their derivatives may aid during the shaping process. An addition or content of at least one boron containing compound may perhaps be used for the complexation or for the stabilization of constituents or both of the aqueous (pre-) treating composition.

Preferably, the aqueous composition for (pre-) treating the shaped articles contains in many embodiments according to the invention besides of water at least one compound of each group of 1) zirconium, titanium and hafnium compounds, 2) hydrofluoric acid, monofluorides, bifluorides and complex fluorides, 3) phosphates, condensed phosphates, phosphonic acids, phosphonates and their derivatives as well as 4. optionally at least one compound each of nitrogen compounds, of organic polymers, copolymers, blockcopolymers and grafted copolymers or of tannins, tannic acid, tannin complexes, phenolic compounds and their derivatives or of any combination thereof. In some embodiments of the present invention, it may contain besides of water at least one compound of each group of 1) zirconium, titanium and hafnium compounds as well as 2) hydrofluoric acid, monofluorides, bifluorides and complex fluorides. In some embodiments, this composition may essentially consist of the compounds as mentioned here above under the groups 1) to 4) or under the groups 1) to 2). Further on, in such embodiments, there may be a small amount of compounds like at least one nitrogen compound like a nitrate or an amine or both, like a sulfate, like a complexing agent or like an additive, whereby the sum of such compounds is often preferably not more than 0.5 g/L, e.g., 0.0001 g/L.

The content of the sum of zirconium, titanium and hafnium in the aqueous (pre-) treating composition is preferably in the range from 0.01 to 15 g/L, more preferred in the range from 0.1 to 12 g/L, most preferred in the range from 0.3 to 8 g/L. The content of the sum of zirconium compounds, titanium compounds and hafnium compounds in the aqueous (pre-) treating composition is preferably in the range from 0.05 to 50 g/L, more preferred in the range from 0.2 to 30 g/L, most preferred in the range from 0.5 to 15 g/L. Within the group of zirconium compounds, titanium compounds and hafnium compounds, the zirconium compounds seem to be the most used or most important ones. The content of the sum of phosphates, condensed phosphates, phosphonic acids, phosphonates and their derivatives in the aqueous (pre-) treating composition calculated by excluding the proportion of the cations is preferably in the range from 0.05 to 25 g/L, more preferred in the range from 0.2 to 12 g/L, most preferred in the range from 0.5 to 8 g/L. The content of the sum of hydrofluoric acid, monofluorides, bifluorides and complex fluorides in the aqueous (pre-) treating composition is preferably in the range from 0.01 to 50 g/L, more preferred in the range from 0.1 to 30 g/L, most preferred in the range from 0.3 to 8 g/L.

The content of the sum of tannins, tannic acid, tannin complexes, phenolic compounds and their derivatives in the aqueous (pre-) treating composition is preferably in the range from 0.01 to 15 g/L, more preferred in the range from 0.1 to 12 g/L, most preferred in the range from 0.3 to 8 g/L. The content of the sum of organic polymers, copolymers, blockcopolymers and grafted copolymers in the aqueous (pre-) treating composition is preferably in the range from 0.01 to 15 g/L, more preferred in the range from 0.1 to 12 g/L, most preferred in the range from 0.3 to 8 or from 1 to 5 g/L. The content of the sum of compounds contained in organic polymeric dispersions or even the dispersions are added as well as the content of waxes in the aqueous (pre-) treating composition is preferably in the range from 0.01 to 10 g/L, more preferred in the range from 0.05 to 7 g/L, most preferred in the range from 0.1 to 4 g/L. The content of the sum of boron containing compounds in the aqueous (pre-) treating composition is preferably in the range from 0.01 to 15 g/L, more preferred in the range from 0.1 to 12 g/L, most preferred in the range from 0.3 to 8 g/L. The content of the sum of inorganic nanoparticles in the aqueous (pre-) treating composition is preferably in the range from 0.01 to 3 g/L, more preferred in the range from 0.03 to 1 g/L, most preferred in the range from 0.05 to 0.5 g/L. The content of the sum of complexing agents, nitrates, sulfates, amines, carboxylic acids, their derivatives as well as additives in the aqueous (pre-) treating composition is preferably in the range from 0.01 to 10 g/L, more preferred in the range from 0.05 to 6 g/L, most preferred in the range from 0.1 to 3 g/L. The content of the sum of silanes, siloxanes, polysiloxanes and their derivatives in the aqueous (pre-) treating composition is preferably in the range from 0.01 to 10 g/L, more preferred in the range from 0.03 to 4 g/L, most preferred in the range from 0.05 to 1 g/L. The content of the sum of aluminum ions, ions of rare earth elements, yttrium ions, manganese ions, molybdenum ions and tin ions in the aqueous (pre-) treating composition is preferably in the range from 0.01 to 6 g/L, more preferred in the range from 0.03 to 3 g/L, most preferred in the range from 0.05 to 1 g/L. Preferably, the content of alkali metal ions is in the range from 0.01 to 3 g/L, more preferred in the range from 0.03 to 1 g/L, most preferred in the range from 0.05 to 0.5 g/L. The content of ammonium ions in the aqueous (pre-) treating composition is preferably in the range from 0.01 to 6 g/L, more preferred in the range from 0.1 to 4 g/L, most preferred in the range from 0.2 to 2 g/L.

Especially preferred is a content of a fluorine compound like a complex fluoride e.g. of zirconium, titanium, hafnium or any combination thereof in the bath of the dome stain (pre-) treatment, often together with a content of at least one phosphorus compound like an orthophosphate.

The application of a mobility enhancer would not be necessary or would be less necessary if the dome stain (pre-) treatment is based on a composition which does not generate a rough, but a well glidable coating like from a composition containing at least one phosphonate or at least one phosphonic acid or both or if there would not be applied any such coating especially in a stage 4 bath or a similar bath of the washer. If, e.g., such a composition is applied and is based on a composition containing at least one phosphonate/phosphonic acid, the generated coating would be effective as a corrosion inhibiting, adhesion promoting and mobility enhancing coating. It has been proved that a coating prepared from an aqueous composition containing at least one phosphonic acid or at least one phosphonate or any derivative or any mixture of it, having an alkyl chain in the molecule, shows a remarkably high mobility enhancing effect. Such a coating may be totally free of zirconium, titanium, hafnium or any combination thereof.

Preferably, the such (pre-) treated shaped articles show a corrosion protecting coating having an essential content of at least one type of fluorine containing anion like fluoride, at least one hydroxide, at least one oxide, at least one phosphate, at least one phosphonate or any combination thereof whereby the coating has a content of hafnium, titanium, zirconium or any combination thereof.

Nevertheless, it is preferred to reduce the amount of fluorine containing compounds as far as possible because of environmental reasons. Therefore, it is in some embodiments preferred that even the baths following the cleaning and rinsing of the shaped metallic articles are totally or essentially free from fluorine.

In an especially preferred process, the shaped metallic bodies or articles are produced by using a fluorine-free cleaning and rinsing process. Typically, today, most of the cleaning baths for aluminum cans are used with a fluorine containing acidic cleaning composition for the etching and cleaning of the shaped metallic articles.

Preferably, the shaped metallic bodies or articles are treated or pre-treated in a washer with baths that are essentially or totally free of fluorine, either having a fluorine content of up to 0.01 g/L of $F_{total}$ or not more than few ppm of fluorine which may be in some situations a constituent e.g. of the water used.

Preferably, the shaped articles are coated with a mobility enhancing composition containing at least one phosphonic acid, at least one phosphonate, at least one derivative thereof or any combination thereof. The therewith generated coating may often be at the same time useful as a corrosion inhibiting and therefore dome stain protecting, adhesion improving and mobility enhancing coating. Therefore, it could preferably be used for the stages 4 or 7 or both, even if it would be only applied one time.

The pH value of a mobility enhancer composition may in some embodiments be crucial too, as above pH 7 of a surfactant based composition salt depositions like salt rings may occur at edges of the shaped articles. Therefore, if the pH would be made slightly acidic e.g. kept in the range from pH 4.5 to pH 6.5 or at a significantly lowered concentration of the mobility enhancer composition or by both, such salt depositions may often be avoided.

Because of the forming of salt depositions and other reasons mentioned above, it is preferred to reduce the content of chemicals in a mobility enhancer composition, perhaps to a significantly lower concentration of at least one surfactant or their derivatives or both like to a range from 0.001 to 0.3 g/L, preferably in a range from 0.05 to 0.12 g/L, or even to avoid such chemicals totally.

The method according to the present invention may be used for the production of hollow articles like a container or like a casing, especially as a beverage can or food can or as a casing for switches.

BRIEF DESCRIPTION OF THE FIGURES

FIG. 1 shows a bath succession of a washer which is typical for a conventional can body (pre-) treatment process today, but which may me used for a body (pre-) treatment process according to the invention, too.

FIG. 2 shows a bath succession of a washer which may be used for a body (pre-) treatment according to the invention in an essentially or totally fluorine-free process.

DESCRIPTION OF PREFERRED EMBODIMENTS

In the process of the (pre-) treatment of these bodies or shaped articles and of the printing of these outside with ink or with paint or with ink and paint (varnish) and perhaps even inside coating with paint, the following process variations may be used in a washer:

Process A: The whole conventional process with all stages as shown in FIG. 1.

Process B: A process with a conventional cleaning and rinsing without a dome stain (pre-) treatment, but with a mobility enhancer (pre-) treatment as shown in FIG. 1.

Process C: A process with a conventional cleaning and rinsing, but without a dome stain (pre-) treatment and without a mobility enhancer (pre-) treatment as shown in FIG. 1.

Process D: A process with a fluorine-free cleaning and rinsing, but the further process was as conventional, which is shown in FIG. 2.

Process E: A process with a fluorine-free cleaning and rinsing, but without a dome stain (pre-) treatment, but with a mobility enhancer (pre-) treatment as shown in FIG. 2.

Process F: A process with a fluorine-free cleaning and rinsing, but without a dome stain (pre-) treatment and without a mobility enhancer (pre-) treatment as shown in FIG. 2.

Optionally, in the processes B, C, E or F or in any further variation of them, at least one of the rinsing stages of water or of DI water or of both may be omitted or a two stage rinsing A/B may be shortened to only one rinsing stage A. Therefore, there are good chances to shorten the process in a washer in many embodiments.

It was surprising that the zirconium content of the zirconium containing coating, especially as a passivation layer, present on the metallic coil or on the metallic sheets tested was not totally removed in the shaping and in the thereon following cleaning process. Therefore, it is believed that the zirconium content of the zirconium phosphate of this layer was at least partially transformed and incorporated into the surface of the aluminum alloy during the shaping including a drawing step and a wall ironing step in the body-makers, especially due to the high pressure and perhaps due to the high temperatures present during shaping.

It was very surprising that the etching of the cans in the stages 0 to 2 of the so-called cleaning did not eliminate the whole content of zirconium in the surface near region of cans, but that there occurred a certain content of zirconium compound(s) despite an acidic cleaning of about 50 to 60 seconds in the stages 0 to 2 together respectively of about 40 to 45 seconds only in stage 2.

It was surprising that the shaping of coated metallic material has improved the tool life because of a higher holding of lube on the metallic surface during the shaping.

It was surprising that the wear of the tools is reduced as there is less oxide on the surface of the metallic material like very hard aluminum oxide which may be very effective as a grinding medium.

It was surprising that the coated metallic material carries the oil, emulsifier(s), ether(s), coolant(s) or any combination of these containing compositions better than conventional uncoated metallic materials.

EXAMPLES AND COMPARISON EXAMPLES

The examples and comparison examples described in the following are intended to elucidate the subject-matter of the invention in more detail. The specified concentrations and compositions in table 1 relate to the aqueous compositions as used in the bath for coating the coil.

A coil made of the aluminum alloy 3104 (AlMg1Mn1) to be used for the production of the body of a beverage can was coated with the aid of a rollcoater at a line speed of 120 m/min with an aqueous composition as shown in table 1 to produce a dried on coating.

The such coated coils had a thin oil containing film of a post-lube which was not removed. The coil was unwrapped in the uncoiler and was lead to the cup-maker, where the coil was first sprayed with an oil containing lubricant on both sides which was then squeezed so that there were films of about 250 mg/m$^2$ on every side before shaping the cups. The cups were then transported to the body-maker, where they were first sprayed with an oil and coolant containing composition which mixed with the dirt and oil containing composition left on the cups to have a lubricant and coolant film during the shaping of long can bodies having a significantly smaller outer diameter and significantly smaller wall thicknesses than the cups. The can bodies were then trimmed at the top to have a defined body length and to create precise edges. They were then transported to the series of baths of the washer.

TABLE 1

Coating compositions and coatings on the coil made of aluminum alloy as well as their properties

| Bath: g/L | Ex. 1 | Ex. 2 | Ex. 3 | Ex. 4 | Ex. 5 |
|---|---|---|---|---|---|
| $H_2ZrF_6$ | 2.3 | 1.15 | 4.6 | 2.3 | 2.3 |
| $H_2TiF_6$ | 3.4 | 1.7 | 0 | 3.4 | 3.4 |
| HF | 0.06 | 0.03 | 0.08 | 0.06 | 0.06 |
| $F_{total}$ | 3.7 | 1.8 | 2.6 | 3.7 | 3.7 |
| $H_3PO_4$ | 0 | 0 | 0 | 0.8 | 3.2 |
| Liquid film | 4 ml/m$^2$ | 4 ml/m$^2$ | 4 ml/m$^2$ | 4 ml/m$^2$ | 4 ml/m$^2$ |
| Coating: | | | | | |
| Coating weight | 12 mg/m$^2$ | 6 mg/m$^2$ | 12 mg/m$^2$ | 13 mg/m$^2$ | 16 mg/m$^2$ |
| Zr weight of coating | 4 mg/m$^2$ | 2 mg/m$^2$ | 8 mg/m$^2$ | 4 mg/m$^2$ | 4 mg/m$^2$ |
| Process: | | | | | |
| Zr weight on body | 3 mg/m$^2$ | | | | |
| Zr weight after cleaning | 2 mg/m$^2$ | | | | |
| Oil reduction for shaping | 10% | | | | |
| Dome stain test | Better than conventional | | | | |
| Tool Life Mobility | >10% + Equal or better than conventl. | | | | |
| Adhesion at necking | Better than conventional | | | | |
| Reduction of chemicals in the washer | >10% | | | | |
| Environmental results | >5% less waste water, less sludge | | | | |

| Bath: g/L | Ex. 6 | Ex. 7 | Ex. 8 | Ex. 8 | Comp. Ex. 1 |
|---|---|---|---|---|---|
| $H_2ZrF_6$ | 2.3 | 2.3 | 2.3 | 2.3 | 0.05 |
| $H_2TiF_6$ | 3.4 | 3.4 | 3.4 | 3.4 | 0 |
| HF | 0.06 | 0.06 | 0.06 | 0.06 | 0.005 |
| $F_{total}$ | 3.7 | 3.7 | 3.7 | 3.7 | 0.30 |
| $H_3PO_4$ | 6.4 | 3.2 | 3.2 | 3.2 | 0.04 |
| $NH_3$ | 0 | 0.5 | 0 | 0 | 0.02 |
| Aminosilane | 0 | 0 | 1.2 | 3.6 | 0 |
| Liquid film | 4 ml/m$^2$ | 4 ml/m$^2$ | 4 ml/m$^2$ | 4 ml/m$^2$ | 4 ml/m$^2$ |
| Coating: | | | | | |
| Coating weight | 20 mg/m$^2$ | 16 mg/m$^2$ | 17 mg/m$^2$ | 20 mg/m$^2$ | 4.5 mg/m$^2$ |
| Zr weight of coating on coil | 4 mg/m$^2$ | 4 mg/m$^2$ | 4 mg/m$^2$ | 4 mg/m$^2$ | — |

In a further example a composition based on ammonium zirconium carbonate together with an organic polymer or a small amount of wax like polyethylene wax or both was applied.

What is claimed is:

1. A method comprising coating a metallic coil or a metallic sheet with an aqueous coating composition by directly applying said aqueous coating on said metallic coil or metallic sheet by at least one method selected from the group consisting of dipping, spraying, rollcoating, electrostatically spraying, dipping and rinsing, dipping and squeezing, spraying and rinsing or spraying and squeezing wherein the aqueous composition comprises water and at least one compound selected from the group consisting of a zirconium compound, a titanium compound, a hafnium compound and combinations thereof to yield a coated metallic coil or metallic sheet;

shaping the coated metallic coil or metallic sheet by cold extruding, deep-drawing, drawing, necking, punching, wall ironing, or by a combination thereof, to form a hollow article or a casing; and cleaning and optionally further coating the hollow article or casing to produce a coated hollow article or casing, wherein said further coating is either chemical pre-treatment or chemical treatment, followed by ink, paint or both ink and paint, wherein the metallic coil or metallic sheet comprises aluminum or aluminum alloy.

2. The method of claim 1, wherein the hollow article is a can.

3. The method of claim 1, wherein the metallic coil or metallic sheet comprises said aluminum alloy.

4. The method of claim 1, wherein the metallic coil or the metallic sheet is coated via a no-rinse process.

5. The method of claim 1, wherein the aqueous coating composition comprises water and at least one compound selected from the group consisting of a titanium compound and a hafnium compound.

6. The method of claim 5, wherein the composition further comprises a phosphate, a condensed phosphate, a phosphonic acid, a phosphonate, hydrofluoric acid, monofluorides, bifluorides, complex fluorides, tannins, tannic acid, tannin complexes, phenolic compounds and derivatives of phenolic compounds, compounds contained in organic polymeric dispersions, an organic polymer, a copolymer, a block copolymer, a grafted copolymer, a wax, a boron-containing compound, an alkali metal compound, an ammonium compound, an inorganic nanoparticle, a nitrate, a sulfate, a silane, a siloxane, a polysiloxane and derivatives of polysiloxane, an aluminum compound, a compound of at least one rare earth element, an yttrium compound, a manganese compound, a molybdenum compound, a tin compound, an amine, a complexing agent, a carboxylic acid, a surfactant, an additive, an organic solvent or derivatives of an organic solvent.

7. The method of claim 1, wherein the coated metallic coil or the coated metallic sheet has a coating with a content of at least one of hafnium, titanium or zirconium in the range from 1 to 50 $mg/m^2$, measured as the element.

8. The method of claim 1, wherein the coated metallic coil or the coated metallic sheet has a coating having a content of at least one type of fluorine containing anion, at least one hydroxide, at least one oxide or at least one phosphate, whereby the coating has a content of hafnium, titanium, zirconium or combinations thereof.

9. The method of claim 1, wherein the coated metallic coil or the coated metallic sheet is shaped in a cup-maker and in a body-maker.

10. The method of claim 1, wherein the coated metallic coil or the coated metallic sheet is shaped in a way that the coating containing at least one compound selected from the group of zirconium compounds, titanium compounds and hafnium compounds is at least partially incorporated into the metallic material during the shaping.

11. The method of claim 1, wherein the coated metallic coil or the coated metallic sheet is shaped in such a way that the hafnium, titanium or zirconium is at least partially taken from the coating into the metallic material.

12. The method of claim 1, wherein the coated metallic coil or the coated metallic sheet is shaped, whereby an oil containing film is maintained on the coated metallic surface of the coil or sheet or both during the shaping.

13. The method of claim 1, wherein the hollow or casing is rinsed, cleaned or both.

14. The method of claim 13, wherein the cleaning is a weak etching whereby there are removed 1 to 12 $mg/m^2$ from the surface of the metallic material.

15. The method of claim 13, wherein a surface of the hollow article or casing which has been rinsed or cleaned or both shows a content of hafnium, titanium or zirconium.

16. The method of claim 1, wherein the hollow article or casing is treated with a solution or dispersion for improving the corrosion resistance, for the mobility enhancement, for paint adhesion or ink adhesion or for any combination thereof.

17. The method of claim 1, wherein the hollow article or casing is produced without applying a mobility enhancer composition on their surfaces.

18. The method of claim 17, wherein the hollow articles or casings are produced with applying a dome stain treatment or pretreatment or a mobility enhancer treatment or pretreatment or both on a surface of the article which contains at least one composition comprising a content of at least one phosphonate or at least one phosphonic acid.

19. The method of claim 1, wherein the hollow article or casing is produced with a fluorine-free cleaning and rinsing.

20. The method of claim 19, wherein the hollow article or casing is treated or pre-treated in a washer with baths that are essentially or totally free of fluorine.

21. The method of claim 20, wherein the hollow article or casing is coated with a mobility enhancing composition containing at least one phosphonic acid, at least one phosphonate, at least one derivative thereof or any combination thereof.

22. The method of claim 1, wherein the coated metallic coil or the coated metallic sheet is dried, and wherein a coating with a coating weight is produced in the range from 4 to 300 $mg/m^2$.

23. A method comprising coating a metallic coil or a metallic sheet with an aqueous coating composition by directly applying said aqueous coating on said metallic coil or metallic sheet by at least one method selected from the group consisting of dipping, spraying, rollcoating, electrostatically spraying, dipping and rinsing, dipping and squeezing, spraying and rinsing or spraying and squeezing wherein the aqueous composition comprises water and at least one compound selected from the group consisting of a zirconium compound, a titanium compound, a hafnium compound and combinations thereof to yield a coated metallic coil or metallic sheet;

shaping the coated metallic coil or metallic sheet by cold extruding, deep-drawing, drawing, necking, punching, wall ironing, or by a combination thereof, to form a hollow article; and cleaning and optionally further coating the hollow article to produce a coated hollow article, wherein said further coating is either chemical pre-treatment or chemical treatment, followed by ink, paint or both ink and paint, wherein the metallic coil or metallic sheet comprises aluminum or aluminum alloy.

24. A method comprising coating a metallic coil or a metallic sheet with an aqueous coating composition by directly applying said aqueous coating on said metallic coil or metallic sheet by at least one method selected from the group consisting of dipping, spraying, rollcoating, electrostatically spraying, dipping and rinsing, dipping and squeezing, spraying and rinsing or spraying and squeezing wherein the aqueous composition comprises water and at least one compound selected from the group consisting of a zirconium compound, a titanium compound, a hafnium compound and combinations thereof to yield a coated metallic coil or metallic sheet;

shaping the coated metallic coil or metallic sheet by cold extruding, deep-drawing, drawing, necking, punching, wall ironing, or by a combination thereof, to form a casing; and cleaning and optionally further coating the casing to produce a coated casing, wherein said further coating is either chemical pre-treatment or chemical treatment, followed by ink, paint or both ink and paint, wherein the metallic coil or metallic sheet comprises aluminum or aluminum alloy.

* * * * *